US006431022B1

(12) United States Patent
Cicotte

(10) Patent No.: US 6,431,022 B1
(45) Date of Patent: Aug. 13, 2002

(54) COMPACT ADJUSTABLE PEDAL SYSTEM

(76) Inventor: Edmond Burton Cicotte, 11086 Hedgeway, Utica, MI (US) 48317

( * ) Notice: Subject to any disclaimer, the term of this patent is extended or adjusted under 35 U.S.C. 154(b) by 0 days.

(21) Appl. No.: 09/680,158

(22) Filed: Oct. 5, 2000

Related U.S. Application Data

(60) Provisional application No. 60/167,161, filed on Nov. 23, 1999.

(51) Int. Cl.[7] ..... G05G 1/14
(52) U.S. Cl. ..... 74/512; 74/560
(58) Field of Search ..... 74/512, 513, 560

(56) References Cited

U.S. PATENT DOCUMENTS

| | | | | |
|---|---|---|---|---|
| 2,550,731 A | | 5/1951 | Tack | |
| 2,550,732 A | | 5/1951 | Tack et al. | |
| 2,884,803 A | | 5/1959 | Willis | |
| 3,151,499 A | | 10/1964 | Roe | |
| 3,282,125 A | | 11/1966 | Dully | |
| 3,356,189 A | | 12/1967 | Tenniswood | |
| 3,486,389 A | | 12/1969 | Cripe et al. | |
| 3,563,111 A | | 2/1971 | Ziegler | |
| 3,828,625 A | | 8/1974 | Bruhn, Jr. | |
| 4,022,081 A | | 5/1977 | Dodd et al. | |
| 4,672,860 A | | 6/1987 | Parker | |
| 4,875,385 A | | 10/1989 | Sitrin | |
| 5,010,782 A | | 4/1991 | Asano et al. | |
| 5,078,024 A | | 1/1992 | Cicotte et al. | |
| 5,136,899 A | | 8/1992 | Hoch et al. | |
| 5,351,573 A | | 10/1994 | Cicotte | |
| 5,460,061 A | | 10/1995 | Redding et al. | |
| 5,690,000 A | | 11/1997 | Terrel | |
| 5,771,752 A | | 6/1998 | Cicotte | |
| 5,823,064 A | | 10/1998 | Cicotte | |
| 5,848,558 A | | 12/1998 | Isono et al. | |
| 5,901,614 A | | 5/1999 | Ewing | |
| 5,913,946 A | | 6/1999 | Ewing | |
| 5,927,154 A | | 7/1999 | Elton et al. | |
| 5,996,438 A | | 12/1999 | Elton | |
| 5,996,439 A | | 12/1999 | Elton et al. | |
| 6,019,015 A | | 2/2000 | Elton | |
| 6,073,515 A | | 6/2000 | Elton et al. | |
| 6,151,986 A | * | 11/2000 | Willemsen et al. | 74/512 |
| 6,178,847 B1 | * | 1/2001 | Willemsen et al. | 74/512 |
| 6,289,761 B1 | * | 9/2001 | Reynolds et al. | 74/512 |
| 6,301,993 B1 | * | 10/2001 | Orr et al. | 74/512 |

FOREIGN PATENT DOCUMENTS

| | | |
|---|---|---|
| EP | 1 028 364 A2 | 8/2000 |
| JP | 58-47923 | 3/1983 |

* cited by examiner

*Primary Examiner*—Chong H. Kim
(74) *Attorney, Agent, or Firm*—Vanophem & Vanophem, P.C.

(57) ABSTRACT

A compact adjustable pedal system for adjusting a pedal with respect to a datum on a reaction member of a vehicle having a support mounted within the vehicle that establishes an axis of actuation for the adjustable pedal system. A pedal arm that includes a pivot end mounted to and pivotable about the axis of actuation, and that extends downward from the pivot end and terminates in a pedal end having the pedal attached thereto. A slave arm is also mounted to and pivotable about a slave axis, and includes an adjustment end opposite the pivot end. A powered screw adjustment device connects the adjustment end of the slave arm to a point on the pedal arm intermediate the pivot end and pedal end. The powered screw is positioned for pivoting the pedal arm with respect to the slave arm, either about the axis of actuation or about an offset end of the pedal arm establishing an axis of adjustment.

21 Claims, 12 Drawing Sheets

COMPACT ADJUSTABLE PEDAL SYSTEM

CROSS-REFERENCE TO RELATED APPLICATIONS

This application, filed Oct. 5, 2000, is a nonprovisional application converted from Ser. No. 60/167,161, a provisional application, abandoned on Nov. 23, 2000.

BACKGROUND OF THE INVENTION

1. Field of the Invention

The present invention generally relates to vehicular control pedals, such as brake, clutch, and accelerator pedals. More specifically, this invention relates to an adjustable vehicle control pedal system having a compact arrangement where the pedals can be selectively adjusted to allow optimum positioning of the pedals relative to an operator of a vehicle.

2. Description of Related Art

Vehicles are conventionally provided with foot-operated control pedals, such as accelerator, brake, and clutch pedals that are used to control the speed of the vehicle. Typically, these control pedals are rigidly fixed to the vehicle body and rotate or pivot away from the driver when foot pressure is applied, and are not adjustable relative to the driver or their respective attachment points. Consequently, the control pedals must generally be attached and positioned relative to the driver of the vehicle to enable operation that is adequately safe and comfortable for the "average" driver. However, some adjustment of the driver's position relative to the control pedals is clearly desirable since the vehicle and its controls must accommodate drivers of various physical attributes. Until recently, this adjustment was accomplished only by adjusting a driver's seat.

Though the driver's seat is usually mounted so as to be slidable in a fore and aft and up and down direction to accommodate drivers of different physiques, such an arrangement is only partially effective in positioning the driver relative to the control pedals. Seat adjustment allows the driver to position himself or herself relative to the vehicle's steering wheel and the control pedals, to some degree improving the driver's comfort and facilitating the driver's ability to operate the vehicle's primary controls. It is, however, nearly impossible for such a solution to accommodate all possible variations in the human frame. In particular, proportional differences between the lengths of a driver's arms, legs and feet in relation to the driver's overall physique cannot be readily accommodated by merely adjusting the seat fore and aft or up and down with respect to the control pedals. Accordingly, it has been recognized that some form of control pedal adjustment is desirable to provide optimal comfort and safety to the driver while also ensuring that the driver can fully operate the control pedals at all times.

Generally, many approaches to providing adjustable control pedals have resulted in pedal systems having an abundance of expensive parts in complex arrangements that occupy a substantial amount of space within a vehicle. Specifically, lever mechanisms are known in the prior art, and the adjustment of one lever with respect to another concentrically mounted lever can also be found in wear or slack adjuster mechanisms. For example, Tack, U.S. Pat. No. 2,550,731, and Tack et al., U.S. Pat. No. 2,550,732, teach a manually operated screw mechanism that is threaded into one lever and operatively connected to associated hangers for adjusting the slack conditions in the brake rigging.

Adjusting of the lever with respect to the hangers and simultaneously modifying the position of the lever where it is connected to the associated brake rigging allows for wear adjustment.

Many other approaches to providing adjustable control pedals have also been suggested in the prior art. One approach is to provide some form of ratchet device that allows the entire control pedal assembly to rotate about a primary pivot point. This approach rotates a housing to which the control pedals are each rotatably attached, thus providing rotation of the control pedals in unison relative to the driver. Examples of this are illustrated in U.S. Pat. Nos. 3,282,125 to Dully; 3,400,607 to Smith; and 3,563,111 to Zeigler. A similar approach is to mount one or more control pedals to a housing, attached to the body of the vehicle, that is slidable fore and aft as a unit relative to the driver, as illustrated in U.S. Pat. Nos. 2,860,720 to Huff et al.; 4,683,977 to Salmon; 5,010,782 to Asano et al.; and British Patent No. 952,831 to Mussell. As taught by Asano et al., the entire housing and pedal assembly rotates about a single pivot point during actuation of the pedals. A disadvantage with pedal systems such as that of Asano et al. is that a spring is required to return the pedal and housing assembly to its initial position, necessitating that the driver also overcome the force generated by the spring in order to actuate the pedal, resulting in an increase of brake pedal effort.

Another suggested approach is a variation on those previously mentioned, employing a screw-actuated device to displace a housing to which one or more control pedals are rotatably mounted. The screw-actuated device can be used to either rotate the entire housing about a pivot point, as shown in U.S. Pat. No. 3,151,499 to Roe, or the screw-actuated device can displace the housing fore and aft, as illustrated by U.S. Pat. Nos. 3,301,088 to White; 3,643,525 to Gibas; 3,765,264 to Bruhn, Jr.; 4,870,871 to Ivan; 4,875,385 to Sitrin; 4,989,474 and 5,078,024 to Cicotte et al.; and 5,460,061 to Redding, et al. Typically, the screw-actuated device is disclosed to be driven by an electric motor that allows the control pedals to be selectively adjusted by the driver from an appropriate actuator switch mounted on the dashboard of the vehicle within the driver's reach.

A further attempt to provide a solution for this problem is disclosed by Rixon et al. in U.S. Pat. No. 5,632,183, wherein a pedal assembly is mounted on a single hollow guide rod extending forwardly from a transmission housing that is pivotably mounted to a bracket secured to a body portion of the vehicle. A helical ball and nut assembly is positioned within the single hollow guide and extends from the transmission housing. A key extends from the nut to the pedal assembly that is mounted to the outside diameter of the single hollow guide so that linear movement of the nut along the helical thread within the hollow guide generates linear movement of the pedal assembly along the hollow guide rod, in forward or rearward directions.

As can be readily appreciated by those skilled in the art, the above examples all require substantial amounts of hardware and space beneath the vehicle's instrument panel to accommodate the device and its associated structure providing the adjustment features. Much of the necessary additional hardware can be attributed to the need to avoid affecting the operation of the brake and/or clutch pedals, during adjustment, with their respective power sources.

From the above discussion, with the exception of the recent Cicotte patents, it can be readily appreciated that the prior art does not disclose a vehicle control pedal arrangement that entails minimal additional hardware to achieve suitable adjustment of one or more control pedals that can be used with a conventional control pedal packaging arrangement without significant structural changes.

An additional problem in adapting adjustable pedal systems to an existing vehicle is that of interference of the pedal hardware with pre-existing structural members such as a steering column. The additional hardware and increased operating envelope of the adjustable pedal system make interference with a steering column more likely. Therefore, it is necessary to design the adjustable pedal system around such structural members, rather than relocating the structural members, so that the adjustable pedal system can be "dropped in place" under the dash of an existing vehicle design.

One related approach was discussed in U.S. Pat. No. 4,022,081 to Dodd et al., that teaches use of a brake pedal having a pedal adapter that allows use of a bent lever arm to avoid obstruction with a stationary member. Dodd et al. disclose a pedal adapter intermediate a push rod and brake lever, where the pedal adapter is offset at a predetermined angle to permit the brake lever to be bent around the steering column to avoid interference therewith. While this solution may suffice for traditional pedal designs, it does not solve the packaging problems of modem adjustable pedal systems. The additional hardware and increased operating envelope of modern adjustable pedal systems demand a more forgiving arrangement. Additionally, it is undesirable to incorporate a bend in the pedal arm. Such a bend may be apposite only in certain vehicle models and not in others. Accordingly, it would be necessary to manufacture multiple versions of the pedal arm to accommodate the different vehicle models. This increases pedal assembly model mix and complexity of vehicle assembly.

Accordingly, what is needed is a cost-efficient adjustment device for adjusting one or more vehicle control pedals, as well as foot rests. The adjustment device is capable of spatially adjusting the control pedals without repositioning the pivot attachment of the conventional control pedal arrangement to adapt to the physical and physiological demands of a driver, and is simultaneously cost effective by requiring minimal structural components and modifications to achieve the desired functional and safety results. Additionally, the adjustment device must also have a connection configuration between a pedal lever and a reaction member that avoids interference with pre-existing structural members.

BRIEF SUMMARY OF THE INVENTION

A compact adjustable pedal system is provided that meets the above-mentioned needs of the prior art. The adjustable pedal system is provided for adjusting a pedal with respect to a datum on a reaction member of a vehicle, such as a brake booster pushrod eyelet, or the head of an accelerator cable. A bracket or support is mounted within the vehicle and establishes at least one axis of actuation for the adjustable pedal system. A pedal arm includes a pivot end that is pivotally mounted about the axis of actuation. The pedal arm extends from the pivot end and terminates in a pedal end having the pedal attached thereto. A slave arm is also mounted to and pivotable about an axis of actuation. The slave arm includes an adjustment end opposite the pivot end. A powered screw adjustment device connects the pedal arm to the slave arm and is positioned for pivoting the pedal arm with respect to the slave arm.

In one embodiment, the adjustment device pivots the pedal arm about the axis of actuation. In another embodiment, the adjustment device pivots the pedal arm about an axis of adjustment at an offset end of the pedal arm.

Accordingly, it is an object of the present invention to provide a vehicle pedal system that is capable of adjusting the positions of control pedals relative to a predetermined datum, such as the pushrod eyelet of a brake booster, or the end of an accelerator or clutch cable, etc.

It is another object of the present invention to provide an adjustable pedal system that is capable of adjusting the positions of one or more vehicle control pedals and that is more compact relative to the prior art.

It is yet another object of the present invention that the adjustment device requires minimal additional hardware so as to minimize the structural modifications required to adapt the adjustment device to a pre-existing vehicle compartment.

It is still another object of the present invention to provide an adjustment device for a vehicle control pedal that reduces the cost of assembly and may drop in place on a current production vehicle.

It is a further object of the present invention to use a lead screw that may be rotated by a manually or electrically driven adjuster mechanism in order to displace the control pedal arm with respect to a datum without any movement of the datum.

It is still a further object of the present invention to provide an adjustable control pedal that uses a compact electric motor with limited movement during operation thereof and is economical and easy to manufacture.

It is yet a farther object to provide an adjustable pedal system that reduces the number of components, reduces the cost of assembly, and requires a single pedal pivot axis such that the system is easily adaptable to an existing pedal mount of a production vehicle.

It is an additional object of the present invention to provide an adjustment device for vehicle control pedals that avoids interference with structural members.

It is yet an additional object of the present invention to provide an adjustment device for vehicle control pedals that can be readily adapted to a pre-existing vehicle compartment without having to relocate any structural members, such as a pre-existing steering column, from its current position.

These objects and other features, aspects, and advantages of this invention will be more apparent after a reading of the following detailed description, appended claims, and accompanying drawings.

DETAILED DESCRIPTION OF THE PREFERRED EMBODIMENT

Generally, while the present invention will be described in detail with respect to adjustable brake and accelerator pedals for an automobile, the adjustment device is also well suited to adjustable pedals for other vehicles, for example, airplanes, trucks, and tractors. Further, the adjustment device is also well suited to clutch pedals, aviation pedals, and foot rests. Accordingly, the present invention is not limited to only vehicle brake and accelerator pedal applications. Typically, a driver's seat is adjustable fore and aft so as to bring the driver closer to the pedal assembly, or to displace the driver further from the pedal assembly, respectively, depending upon the driver's particular physique and preference. The adjustable pedal system of the present invention supplements or replaces the adjustable feature of the driver's seat.

Figure 1:
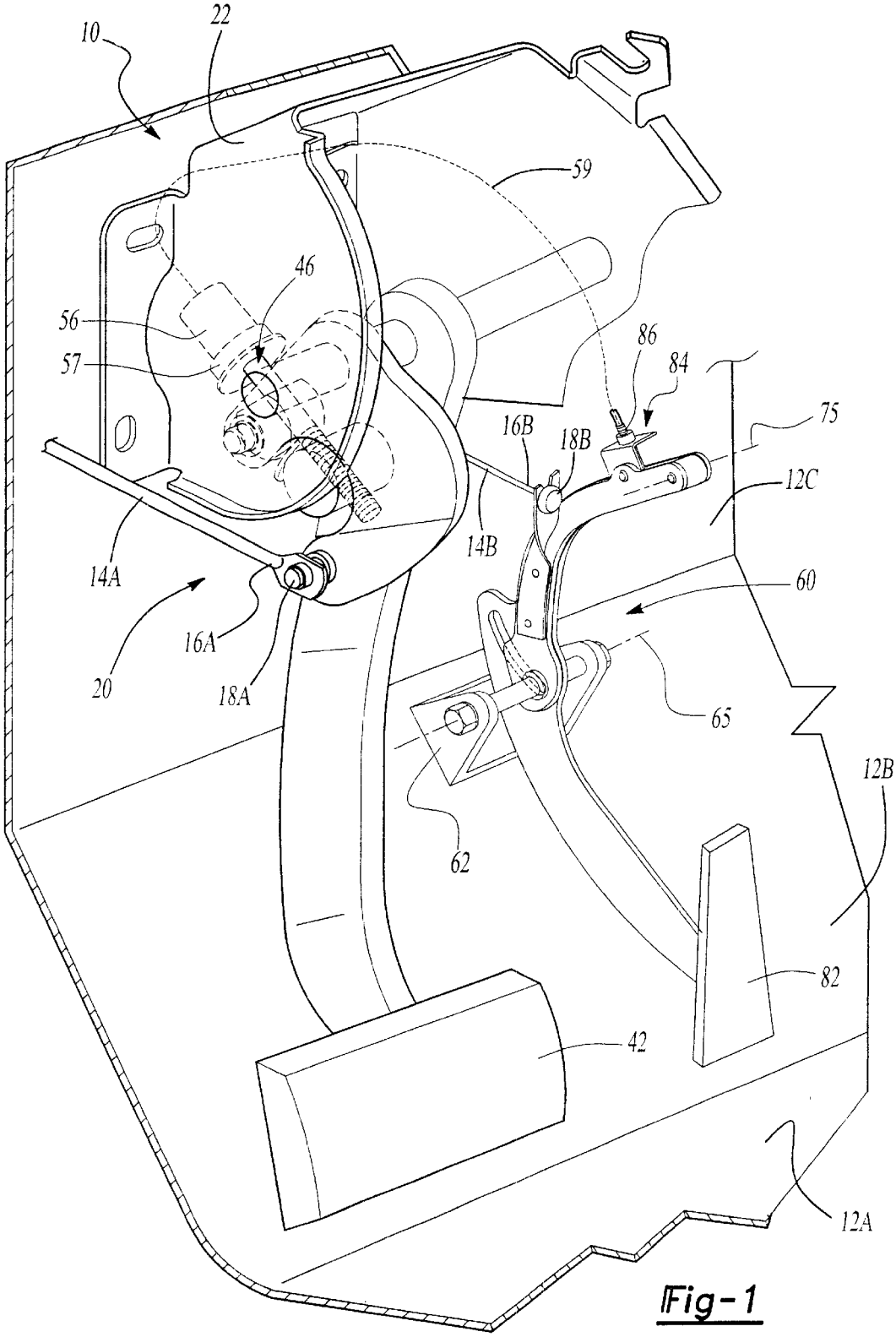
FIG. 1 is a fragmentary perspective view of an adjustable pedal system according to the present invention.

Specifically referring in structural detail to the Figures, there is shown in FIG. 1 a compact adjustable pedal system 10 within a vehicle passenger compartment. The passenger compartment includes a floor 12A, a toe panel 12B, and a dash panel 12C. Those skilled in the art will recognize that a reaction member or pushrod 14A extends rearward through the dash panel 12C into the vehicle passenger compartment, and that a forward end of the pushrod 14A connects to a brake cylinder or other device in an engine compartment (not shown), just forward of the dash panel 12C. Additionally, a spring (not shown) within the brake cylinder naturally biases the pushrod 14A in a released and fully rearward position. A rearward end 16A of the pushrod 14A includes an eyelet 18A that establishes a datum and that attaches to an adjustable brake pedal system 20. The adjustable brake pedal system 20 is preferably installed in the vehicle as a separate self-contained module. The adjustable brake pedal system 20 includes a support or mounting bracket 22 that preferably fastens to the dash panel 12C, but may fasten to other mounting surfaces within the passenger compartment.

In addition to the pushrod 14A, another reaction member, or accelerator cable 14B, extends through the dash panel 12C into the vehicle passenger compartment. A rearward end 16B of the accelerator cable 14B includes a head 18B that establishes a datum and attaches to an adjustable accelerator pedal system 60. The adjustable accelerator pedal system 60 is also preferably installed in the vehicle as a separate self-contained module. The adjustable accelerator pedal system 60 includes a mounting bracket 62 that preferably mounts to the toe panel 12B.

Figure 2:
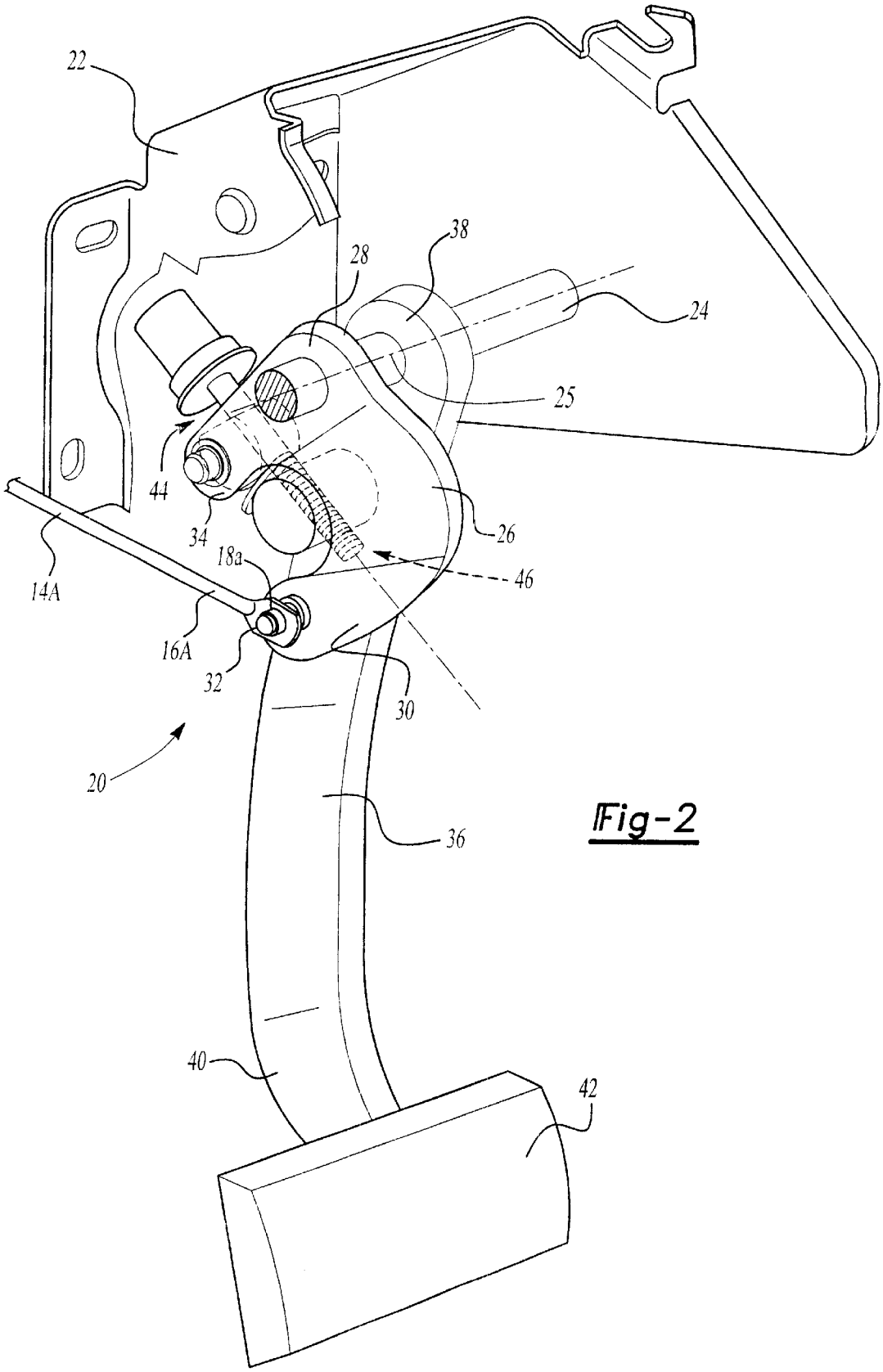
FIG. 2 is a perspective view of an adjustable brake pedal system of the adjustable pedal system of FIG. 1.
Figure 3A:
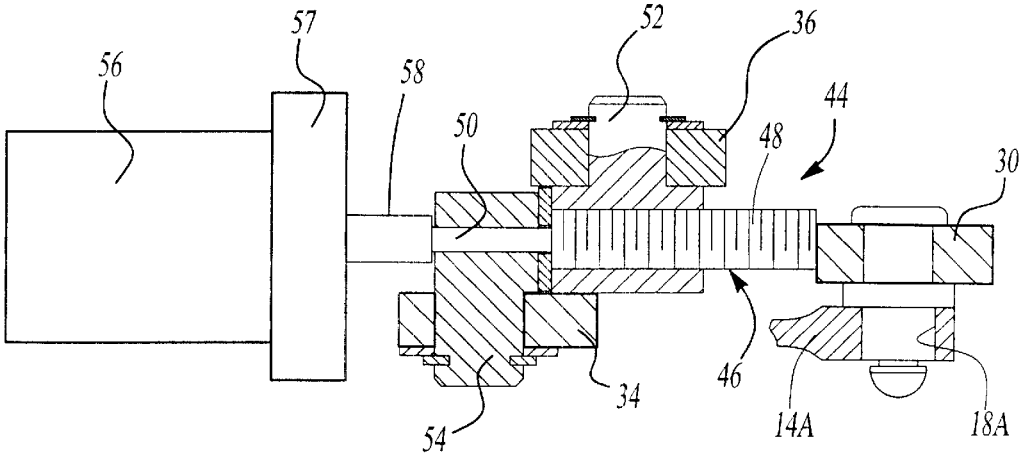
FIG. 3A is a cross-sectional view illustrating the unique compactness of the adjustable brake pedal system of FIG. 3 taken along lines 3A—3A thereof.
Figure 4A:
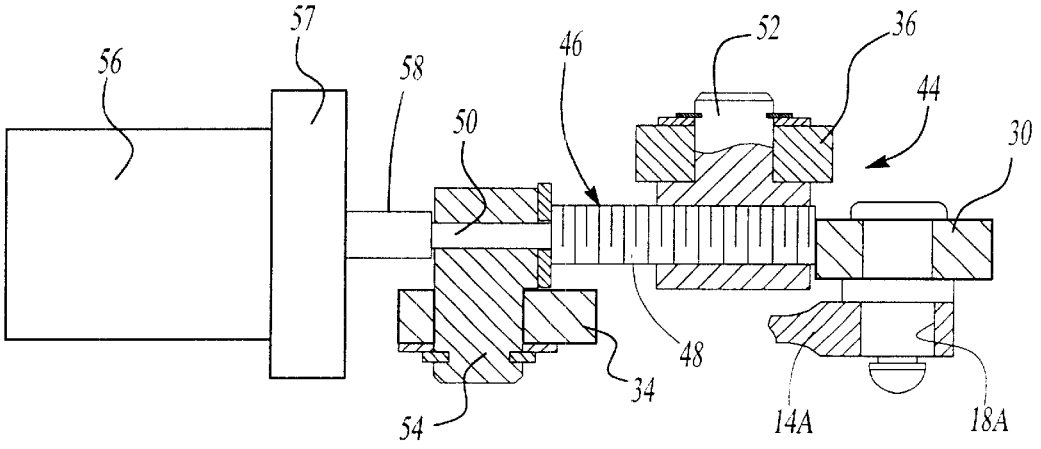
FIG. 4A is a cross-sectional view illustrating the unique compactness of the pedal system of FIG. 4 taken along lines 4A—4A thereof.

Referring now specifically to the adjustable brake pedal system 20 of FIG. 2, a mounting pin or support 24 is mounted to the mounting bracket 22, as is well known in the art, for establishing an axis of adjustment and actuation 25. A bellcrank, or slave arm 26 shaped as a bellcrank, includes an apex or pivot end 28 that pivotably mounts about the support 24. An adjustment end 34 of the slave arm 26 extends downward from the pivot end 28, and a reaction end 30 likewise extends downward from the pivot end 28 and is angularly offset with respect to the adjustment end 34 in a rearward direction. The reaction end 30 is connected to the eyelet 18A of the pushrod 14A by a reaction pin 32 that may be fastened in any reasonable manner so long as the reaction pin 32 is rotatable with respect to the reaction end 30 and the eyelet 18A. As best shown in FIGS. 3A and 4A, the adjustment end 34 is also axially offset from the reaction end 30 in a direction parallel to the axis of adjustment and actuation 25.

Referring again to FIG. 2, the adjustable brake pedal system 20 includes a pedal arm 36 having a pivot end 38 that pivotably mounts about the support 24 next to the slave arm 26. The pedal arm 36 extends downward from the pivot end 38 to a pedal end 40 and terminates in a pedal 42. Intermediate the pivot and pedal ends 38 and 40 of the pedal arm 36, an adjustment device 44 connects the pedal arm 36 to the adjustment end 34 of the slave arm 26. The adjustment device 44 preferably includes an adjustment screw 46, but alternatively may include a solenoid, a linear stepping device, or any other commonly known method for effecting translation of componentry. Preferably, the adjustment screw 46 is a well known and commercially vailable ⅜-10 ACME lead screw.

Figure 3:
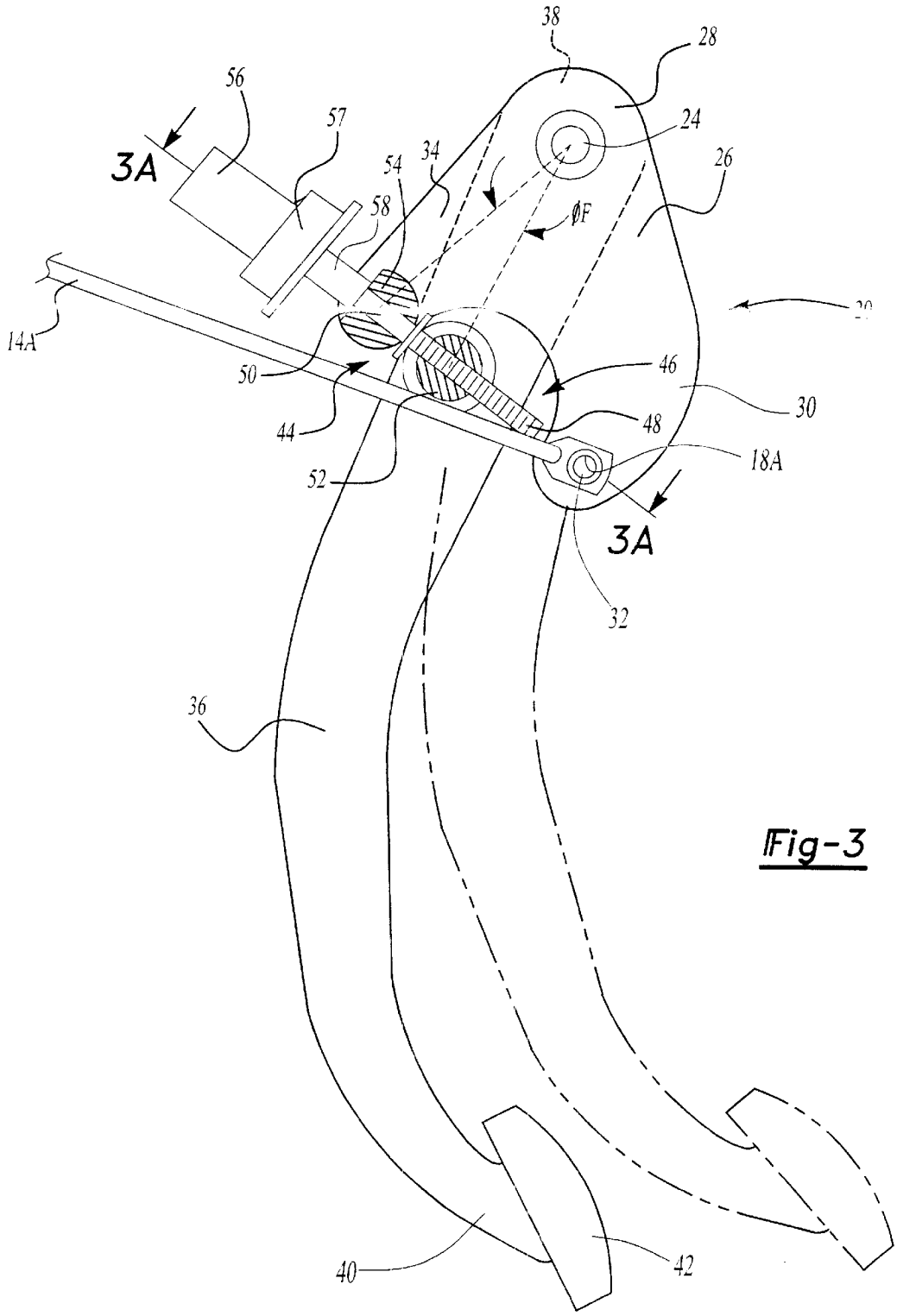
FIG. 3 is a side view illustrating adjustment of the adjustable brake pedal system of FIG. 2 from a forward-most position of adjustment in solid lines, to a rearward position in phantom lines.
Figure 4:
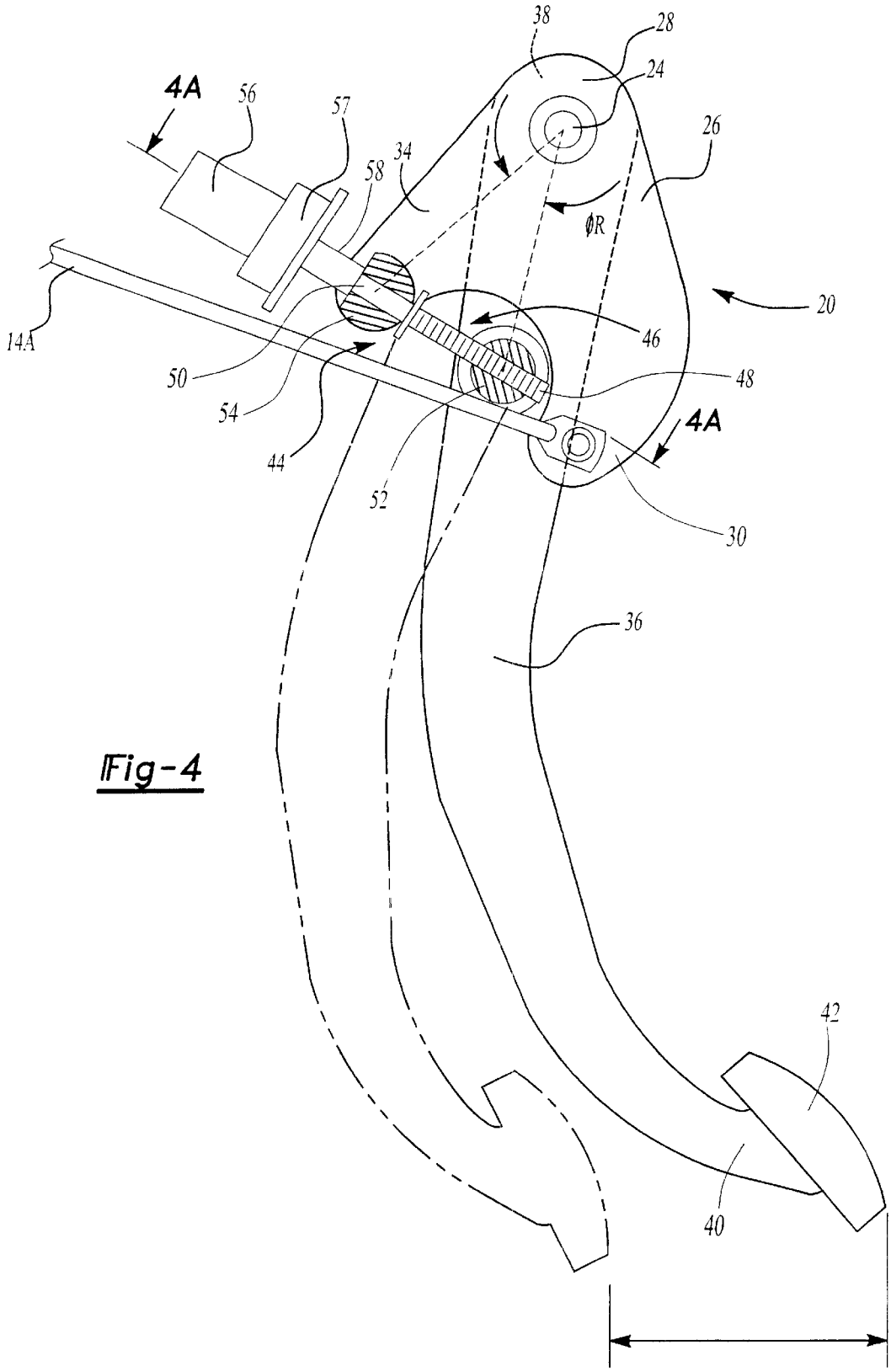
FIG. 4 is a side view illustrating adjustment of the adjustable brake pedal system of FIG. 2 from a rearward-most position of adjustment in solid lines, to a forward position in phantom lines.

FIGS. 3 through 4A show the adjustment device 44 including the adjustment screw 46, a pedal arm pin 52, a slave arm pin 54, and the slave arm 26. The adjustment screw 46 includes a threaded body portion 48 that is threadably received within a threaded portion of the pedal arm 36 or preferably within a threaded portion of the pedal arm pin 52. The pedal arm pin 52 may be fastened in any known manner to the pedal arm 36, such as by a circlip arrangement as shown, so long as it is rotatable within the pedal arm 36. A stem portion 50 of the adjustment screw 46 extends forward through the slave arm pin 54. The slave arm pin 54 may be fastened to the slave arm 26 in any known manner so long as it is rotatable within the adjustment end 34. Positive contact is maintained at all times between the slave arm 26 and the pedal arm 36 by the threaded body portion 48 of the adjustment device 44, thus ensuring positive mechanical action therebetween.

Alternatively, the adjustment screw 46 can instead be threaded into the slave arm pin 54 in the adjustment end 34 with the stem portion 50 extending through the pedal arm pin 52 in the pedal arm 36. In other words, the adjustment mechanism can be reversed in position, and in attachment, between the pedal arm 36 and adjustment end 34 of the slave arm 26.

The adjustment device 44 preferably includes a drive motor 56 and gearbox 57 connected to the stem portion 50 via a coupling 58, as is well known in the art. Though any suitable type of drive motor can be used, it is preferable in the environment of a vehicle's passenger compartment to use an electric drive motor that generates minimal noise. A suitable output speed for the drive motor 56 is on the order of about 10 to 12 rpms, though it is foreseeable that different motors could be matched with different gearboxes to produce higher or lower output speeds.

Alternatively, the adjustment device 44 can include the drive motor 56 without the gearbox 57, or can include a drive unit remote from the adjustment screw 46, but drivingly connected by a cable and gear drive as is well known in the art. For example, a Bowden cable assembly can be employed to permit automatic or manual adjustment if desired.

Referring now in operational detail to the adjustable brake pedal system 20, FIGS. 3 and 4 best illustrate the forward and rearward adjustment of the adjustable brake pedal system 20 respectively. The pedal arm 36, the adjustment end 34 of the slave arm 26, and the adjustment device 44 form a triangular linkage arrangement. The adjustment device 44 forms one side of the triangle, just opposite of the support 24 and the angle through which the pedal arm 36 rotates. The adjustment device 44 is of variable length to vary the angular position of the pedal arm 36 with respect to the adjustment end 34 such that the angle between the two increases from $\phi_F$ in the forward-most position to $\phi_R$ in the rearward-most position, as shown in FIGS. 3 and 4, respectively.

When it is desired to adjust the position of the pedal arm 36, the drive motor 56 is energized either automatically by the vehicle, or upon activation by the operator of the vehicle. The drive motor 56 and gearbox 57 rotate the adjustment screw 46 in one direction when the drive motor 56 is activated in a first direction and rotate the adjustment screw in an opposite direction when the drive motor is activated in a second direction. Rotation of the adjustment screw 46 threadingly drives the pedal arm pin 52 and thereby varies the length of the adjustment device 44 to change the angular position of the pedal arm 36 relative to the slave arm 26, and thus move the position of the pedal 42 to a desired position of the vehicle operator.

FIG. 3 shows the pedal arm 36 in solid lines in a forward-most adjustment position. Here, the adjustment device 44 has been shortened by rotation of the adjustment screw 46 in order to draw the pedal arm pin 52 toward the slave arm pin 54, thus causing the pedal arm 36 to be pivoted to the forward-most position. FIG. 4 illustrates adjustment of the pedal arm 36 to a rearward-most position. Here, the drive motor 56 must be actuated to rotate the adjustment screw 46 for threading the pedal arm pin 52 away from the slave arm pin 54, thus causing the pedal arm 36 to be pivoted away from the forward-most position, as shown in phantom lines, toward the rearward-most position, as indicated in solid lines. The angular travel of the pedal arm 36 is constrained by interference of the pedal arm pin 52 against the reaction end 30 in the rearward-most position, and against the adjustment end 34 in the forward-most position, as best shown in FIGS. 3A and 4A.

FIGS. 3A and 4A illustrate the adjustment device 44 in fully forward and fully rearward adjustment positions, respectively. As shown in FIG. 3A, the adjustment screw 46 may be rotated so as to threadingly drive the pedal arm pin 52 and pedal arm 36 rearward to the fully rearward position as shown in FIG. 4A, or anywhere in between. The drive motor 56 and gearbox 57 are preferably splined to the stem portion 50 of the adjustment screw 46 via the coupling 58, as is well known in the art. The drive motor 56 and gearbox 57, however, may be attached in any way to the slave arm pin 54 so long as the drive motor 56 and gearbox 57 are free to pivot with the slave arm pin 54 with respect to the slave arm 26.

Figure 5:
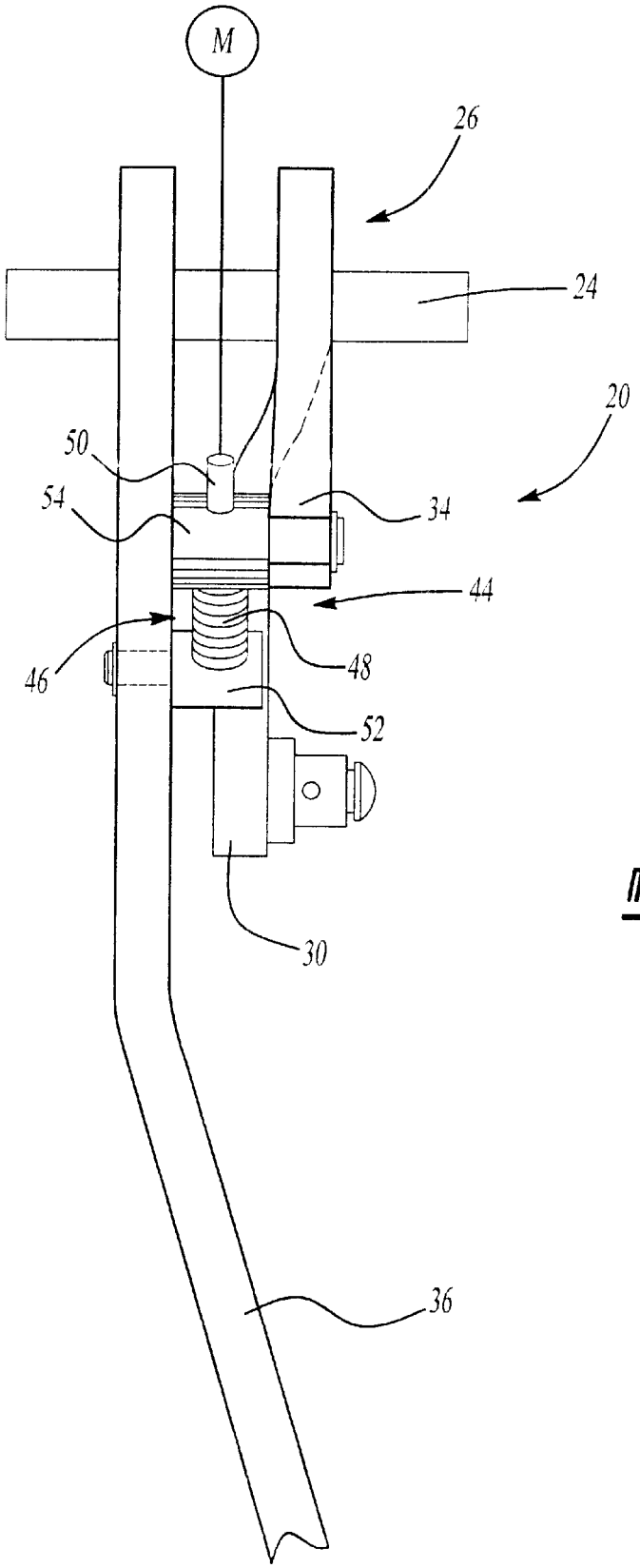
FIG. 5 is a view of the present invention of FIG. 2, from the front of the vehicle looking rearward.

FIG. 5 illustrates a view of the adjustable brake pedal system 20 from the front of the vehicle looking rearward, and illustrating how the adjustment device 44 connects the pedal arm 36 to the adjustment end 34 of the slave arm 26. The symbol M represents the drive motor and gearbox. The stem portion 50 of the adjustment screw 46 passes through the slave arm pin 54 so that the slave arm pin 54 is trapped between the drive motor and gearbox M and the threaded body portion 48 of the adjustment screw 46. The adjustment screw 46 is threaded into the pedal arm pin 52. The pedal arm pin 52 is translatable along the threaded body portion 48 and is trapped between the reaction end 30 of the slave arm 26 and the slave arm pin 54.

Figure 6:
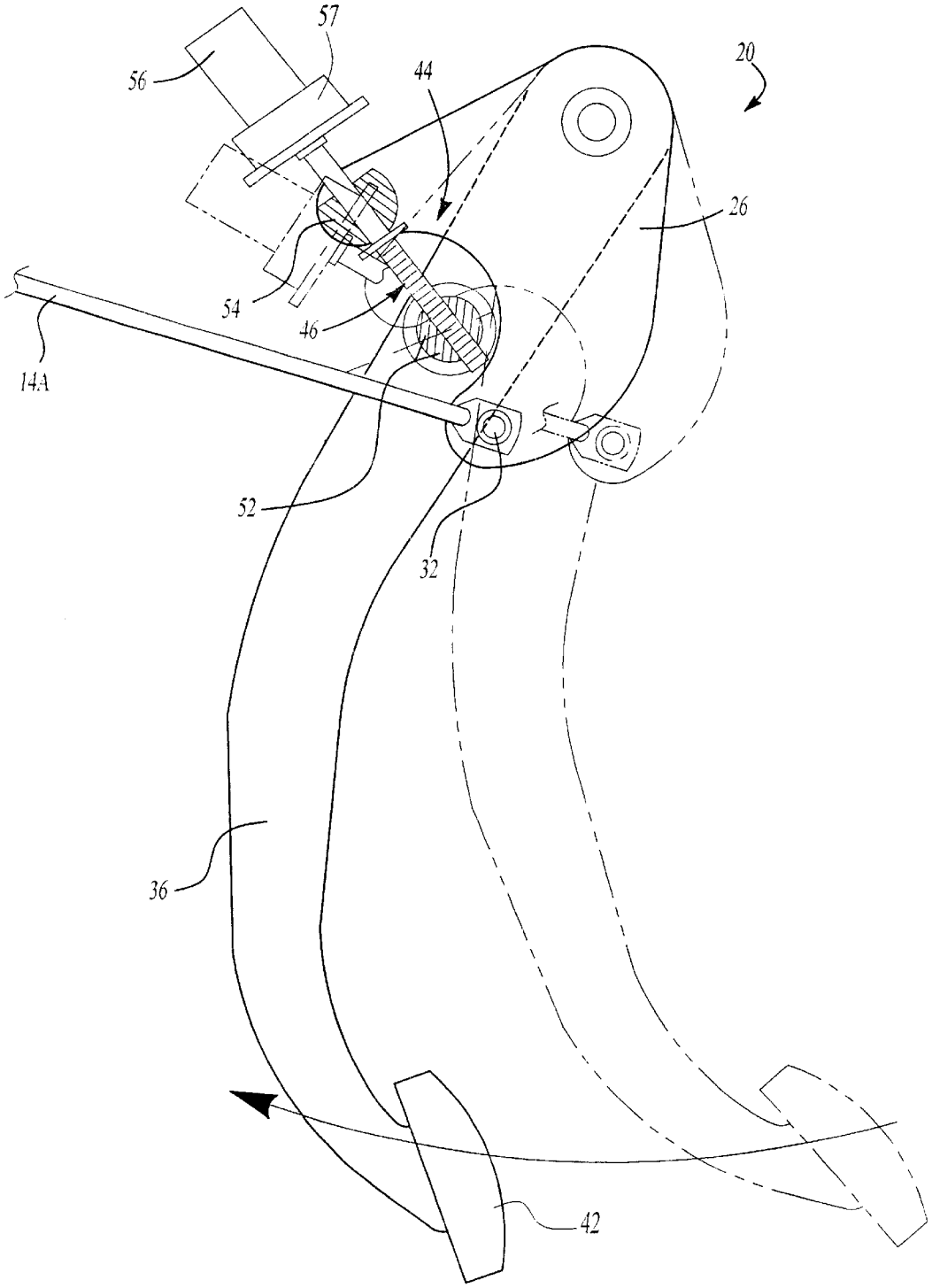
FIG. 6 is a side view illustrating the present invention of FIG. 2 being actuated from a state of rest in the rearward-most position of adjustment, as shown in phantom lines, to a forward braking position of the present invention shown in solid lines.

FIG. 6 best illustrates actuation, or braking operation, of the adjustable brake pedal system 20 between a rearward-most adjustment position and a forward braking position as the operator's foot applies forward pressure to the pedal 42. Thus, the pedal arm 36 actuates the pushrod 14A indirectly through the adjustment device 44 and slave arm 26. The pedal arm 36 is shown in phantom lines in a relaxed state in its rearward-most adjustment position and is shown in solid lines in a forward actuated position. Because the pedal arm 36 is solidly connected to the pushrod 14A through the adjustment device 44—including the pedal arm pin 52, adjustment screw 46, slave arm pin 54, slave arm 26, and reaction pin 32—the adjustment device 44 is pivoted commensurately to a forward position. Thus, pivotal braking motion of the pedal arm 36 is smoothly converted to linear motion of the pushrod 14A using the triangular linkage of the adjustment device 44, incorporating the pivotably mounted pins 52 and 54.

Figure 7:
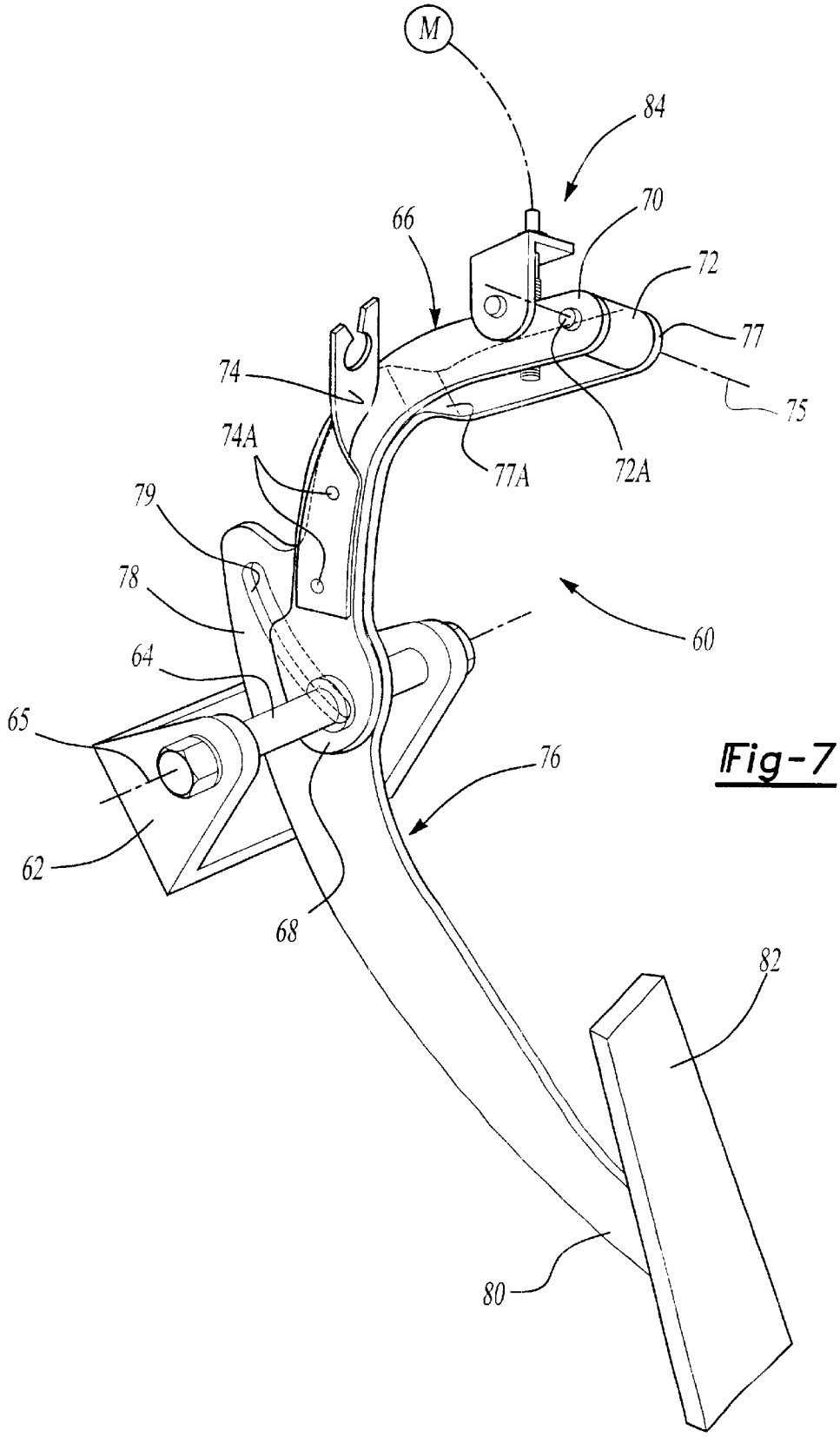
FIG. 7 is a perspective view of an adjustable accelerator pedal system of the adjustable pedal system shown in FIG. 1.
Figure 8:
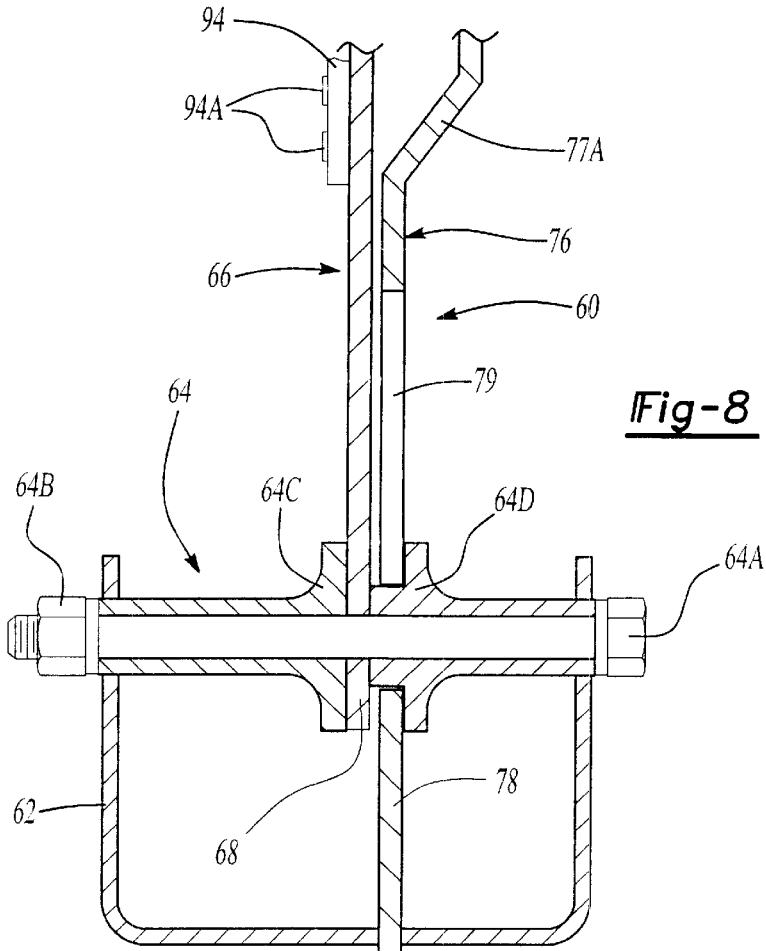
FIG. 8 is a sectional-view of the adjustable accelerator system as shown in FIG. 7, taken from the rear of the vehicle looking forward.

Referring now to FIGS. 7 through 11, there is shown the adjustable accelerator pedal system 60 according to the present invention. FIGS. 7 and 8 illustrate the mounting bracket 62 sustaining a support 64. The support 64 includes a bolt 64A extending through flanges of the mounting bracket 62, through a pivot end 68 of a slave arm 66, and through a pivot end 78 of a pedal arm 76. As shown in FIG. 8, a nut 64B threads to the bolt 64A to retain the support 64 to the mounting bracket 62 and trap the slave arm 66 tightly between opposed collars 64C and 64D of the support 64. The slave arm 66 is also interlocked in any known fashion to the support 64 to prevent relative motion therebetween. For example, the pivot end 68 of the slave arm 66 may be splined to the collars 64C and 64D. Thus, the slave arm is rigidly, but rotatably, fixed to the vehicle via the support 64 and mounting bracket 62. In contrast, the pedal arm 76 is loosely retained between the collars 64C and 64D, such that relative motion therebetween is possible. An arcuate slot 79 in the pedal arm 76 enables the pedal arm 76 to be arcuately displaced with respect to the support 64. Thus, the support 64 establishes an axis of actuation 65 such that the support 64, slave arm 66, and pedal arm 76 are pivotable about the axis of actuation 65 with respect to the mounting bracket 62.

Figure 9:
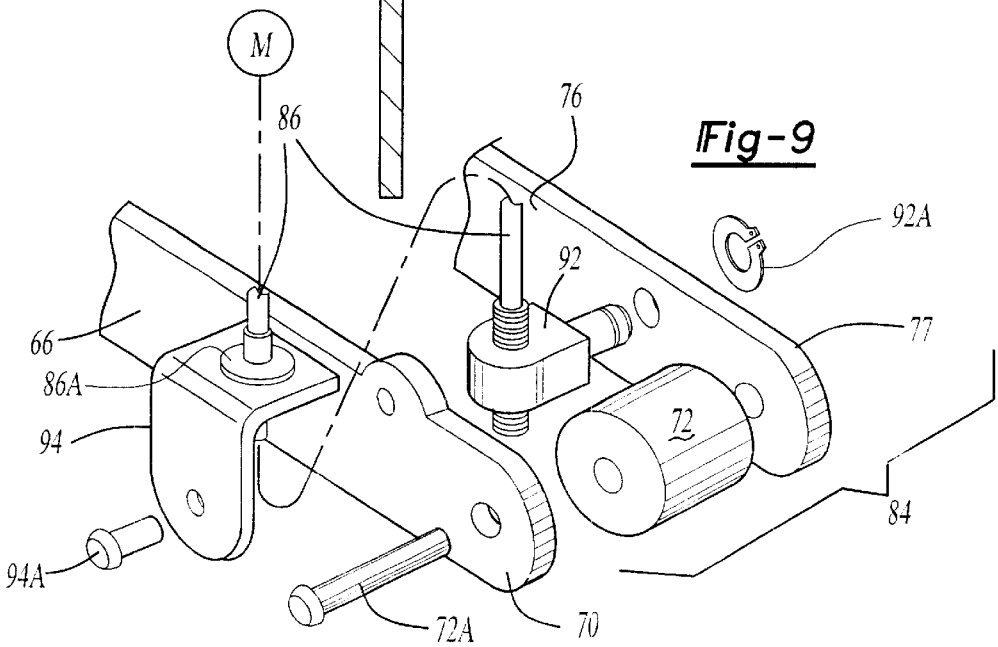
FIG. 9 is an exploded perspective view of the upper portion of the adjustable accelerator pedal system of FIG. 7.

As shown in FIG. 7, the slave arm 66 extends arcuately upward from the pivot end 78 and terminates in an adjustment end 70. Attached to one side of the slave arm 66 is an accelerator cable bracket 74 that provides a datum attachment portion for attaching to the accelerator cable 14B of FIG. 1. The bracket 74 may be fastened by riveting with rivets 74A, or by welding, or the like, or may be an integral portion of the slave arm 66. As best shown in FIG. 9, a spacer 72 spaces the adjustment end 70 of the slave arm 66 to an offset end 77 of the pedal arm 76. Those skilled in the art will recognize that the spacer 72, offset end 77, and adjustment end 70, may be attached by any known method such as a rivet 72A, a bolt and nut combination, or the like. Therefore, the pedal arm 76 is rigidly, but rotatably and adjustably, fixed to the vehicle by the spaced attachment of its offset end 77 to the adjustment end 70 of the slave arm 66. Accordingly, the pedal arm offset end 77 is pivotally aligned and attached to the adjustment end 70 of the slave arm 66 such that the offset and adjustment ends 77 and 70 define an axis of adjustment 75, as shown in FIG. 7. Proximate the adjustment end 70 and offset end 77, a preferred adjustment device 84 is mounted between the slave arm 66 and pedal arm 76.

As shown in FIG. 9, an adjustment screw 86 is threadingly received by a threaded pedal arm pin 92 that is pivotably received through the pedal arm 76. Preferably, the pedal arm pin 92 is circlipped to the pedal arm 76 with a circlip 92A as is well known and shown in exploded view. In turn, the adjustment screw 86 is rotatably fastened to a slave arm bracket 94 by a ROTO clip 86A as is known in the art, although any rotatable fastening configuration could be used including a circlip arrangement. The slave arm bracket 94 is rotatably fastened to the slave arm 66 by a rivet 94A. Thus as the adjustment screw 86 is rotated, the pedal arm pin 92 threadingly traverses the length of the adjustment screw 86 to effect pivotal motion of the pedal arm 76, as described previously.

Figure 10:
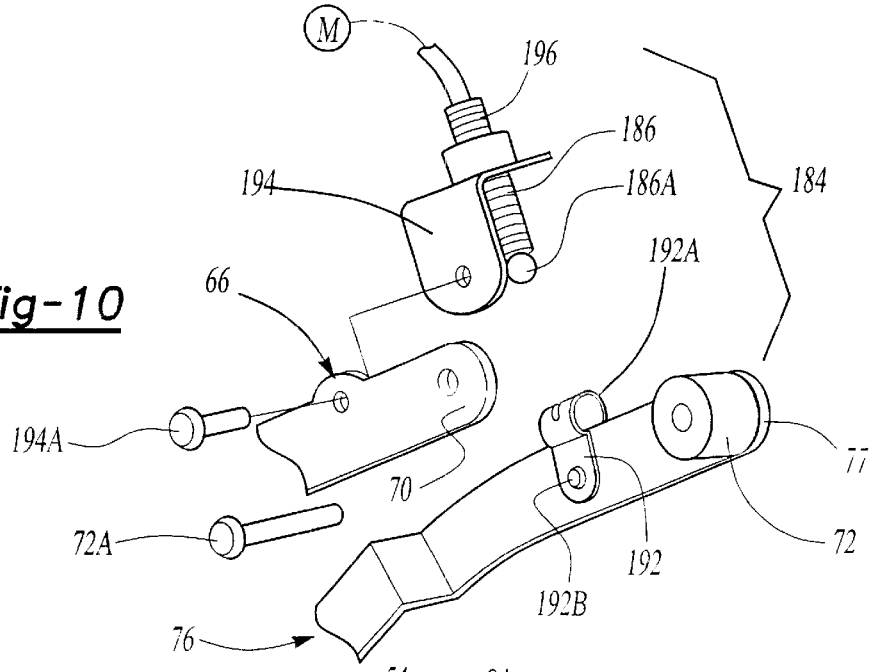
FIG. 10 is an exploded perspective view of an alternative embodiment of the upper portion of FIG. 7.

An alternative adjustment device 184 is illustrated in FIG. 10. Here, an adjustment screw 186 is threadingly received into a nut portion 196 of a slave arm bracket 194. The slave arm bracket 194 is pivotably attached to the slave arm 66 by a rivet 194A or the like. A ball end 186A of the adjustment screw 186 is received by a pedal arm bracket 192 having a socket 192A that interlockingly accepts the ball end 186A of the adjustment screw 186. The pedal arm bracket 192 is rotatably fastened to the pedal arm 76 by a rivet 192B or the like. Thus, as the adjustment screw 186 is rotated, the adjustment screw 186 traverses through the nut portion 196 of the slave arm bracket 194 to either push or pull, depending upon the direction of rotation, the pedal arm bracket 192 and pedal arm 76, for pivoting the pedal arm 76 about the axis of adjustment.

Accordingly, the adjustment devices 84 and 184 of FIGS. 9 and 10 positively and pivotably connect the slave arm 66 to the pedal arm 76 at a predetermined distance from the offset and adjustment ends 77 and 70. A distance of approximately 1 ½" is shown in the Figures and is sufficient to effect articulation of the pedal arm 76 with respect to the slave arm 66. Articulation or adjustment of the position of the pedal arm 76 with respect to the slave arm 66 is effected by operation of the adjustment devices 84 and 184, as described previously. As shown in FIG. 1, the adjustment device 84 is connected via a drive cable 59 to the gearbox 57 and motor 56, consistent with power take-off connections well known to those of ordinary skill in the art. Thus, the adjustment device 84 operates to pivot the pedal arm 76 about the axis of adjustment 75, and the pedal arm 76 and slave arm 66 are pivotable about the axis of actuation 65 upon a force applied by an operator of the vehicle to a pedal 82 attached to a pedal end 80 of the pedal arm 76.

Figure 11:
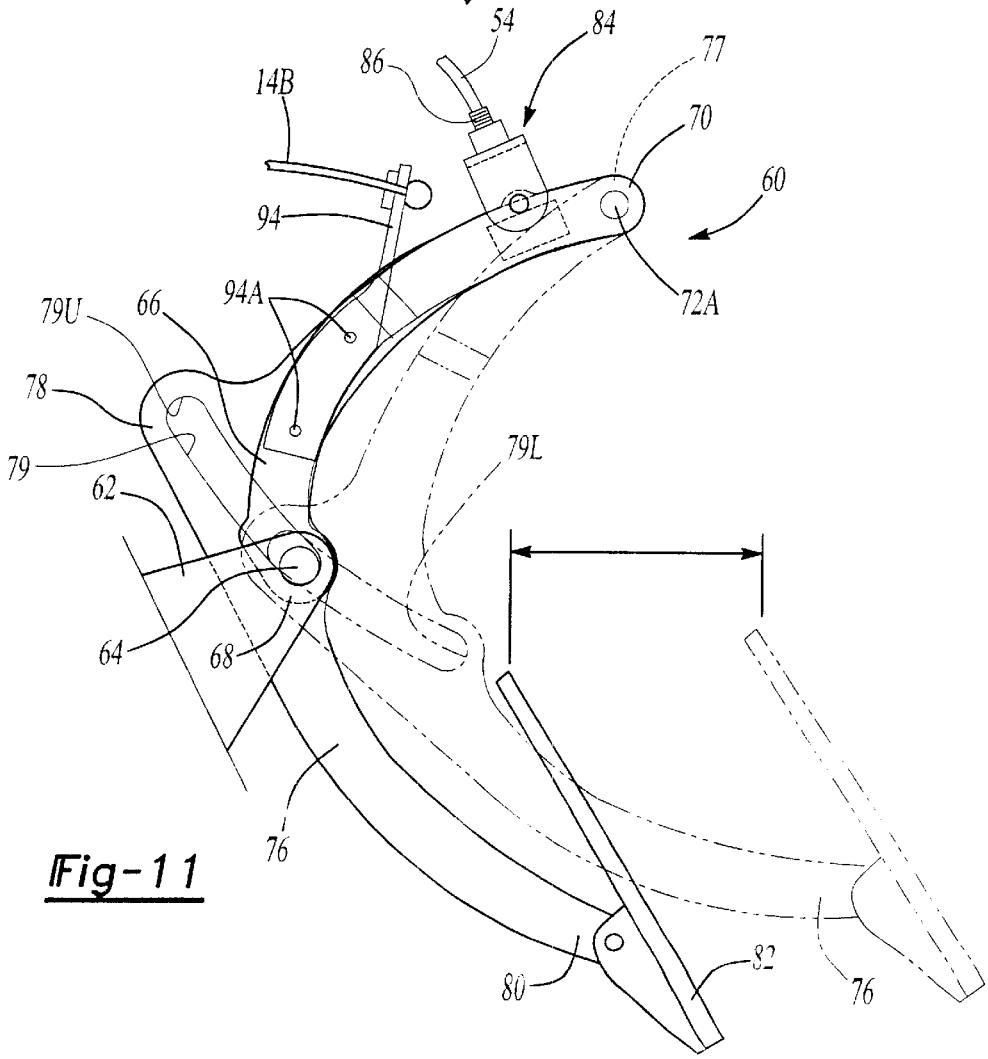
FIG. 11 is a side view of the adjustable accelerator pedal system of the present invention shown in FIG. 7 showing the accelerator pedal adjusted to a rearward position in phantom lines.

FIG. 11 best illustrates adjustment of the pedal arm 76. As shown in solid lines, the pedal arm 76 is in a fully forward position, and restricted from further forward adjustment by a lower end 79L of the arcuate slot 79 against the support 64. In the fully forward position of the pedal arm 76, the adjustment device 84 is in a fully retracted position. To adjust the pedal arm 76 from the fully forward position to a fully rearward position, as shown in phantom lines, the adjustment device 84 is actuated to a fully advanced position. Accordingly, the pedal arm 76 reaches its fully rearward position when an upper end 79U of the arcuate slot 79 is stopped by the support 64. The adjustment screw 86 is rotated by the drive cable 59 to cause rearward pivoting of the pedal arm 76. Opposite rotation of the adjustment screw 86 causes forward pivoting of the pedal arm 76. When the operator applies an accelerator force to the pedal 82, the entire assembly—including the pedal 82, pedal arm 76, spacer 72, slave arm 66, and support 64—pivots simultaneously about the axis of actuation established by the support 64.

Referring again to FIG. 1, when the operator desires to adjust the position of the pedals 42 and 82, the operator activates the drive motor 56, such as by a switch on the instrument panel of the vehicle. It is also contemplated that the drive motor 56 may be automatically activated upon receiving a signal from the vehicle itself. Upon activation, the drive motor 56 rotates in the desired direction thereby driving the gearbox 57 that directly rotates the adjustment screw 46 of the adjustable brake pedal system 20 while indirectly rotating the adjustment screw 86 of the adjustable accelerator pedal system 60 via the drive cable 59.

Figure 12:
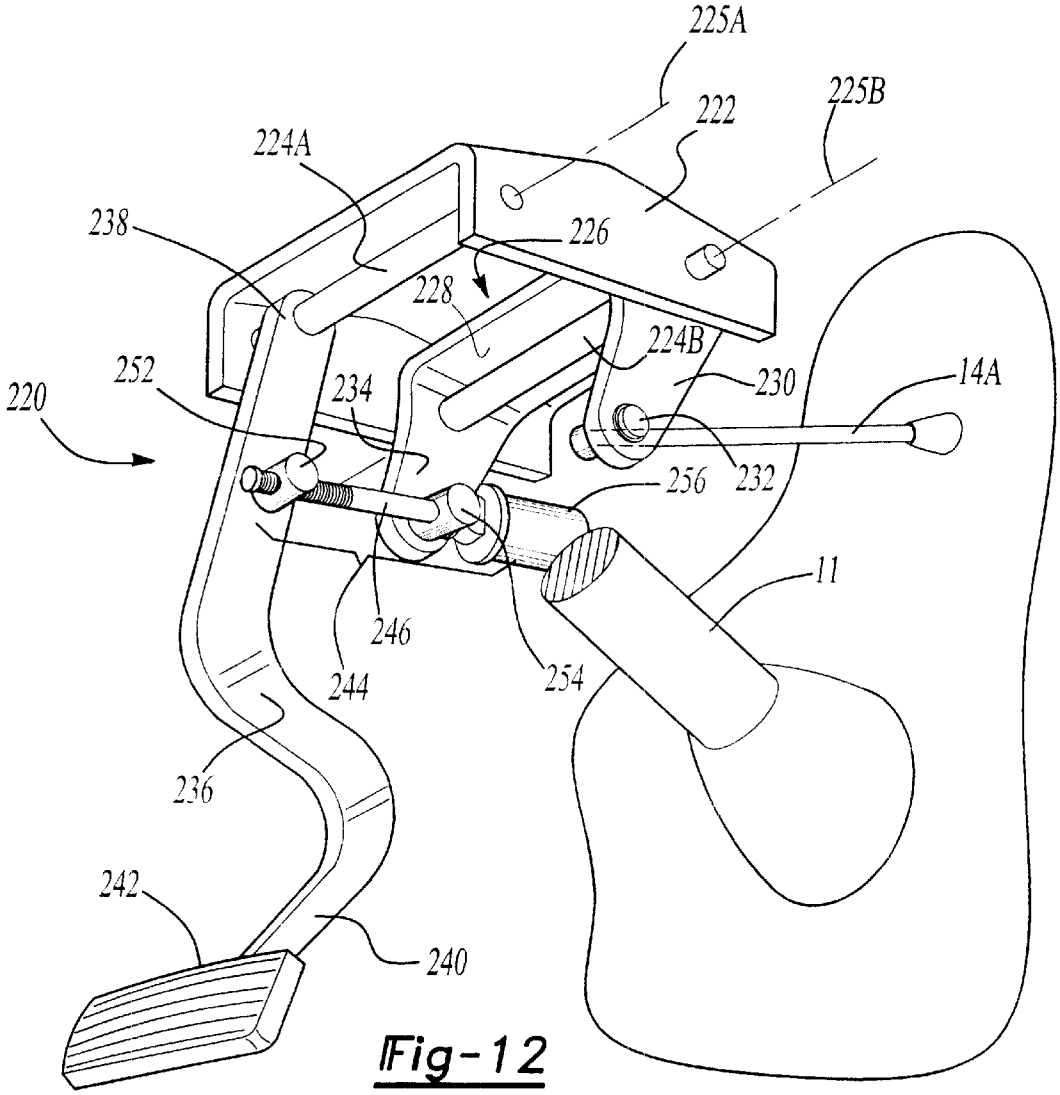
FIG. 12 is a perspective view, taken at an angle from below, of an alternative adjustable brake pedal system.
Figure 13:
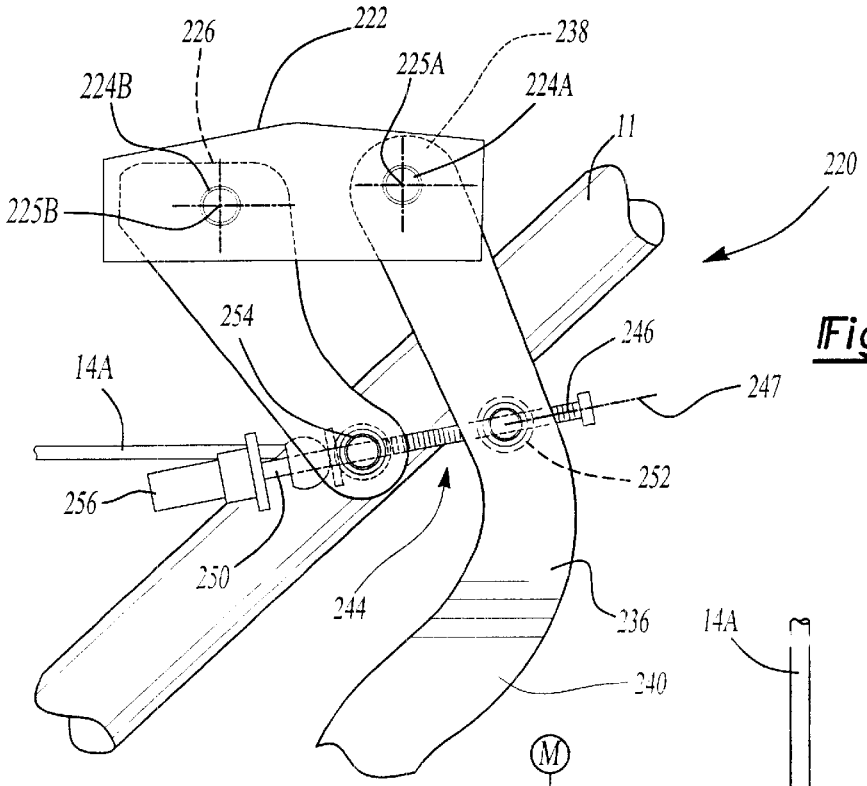
FIG. 13 is a partially cutaway enlarged side view of the adjustable pedal system of FIG. 12.
Figure 14:
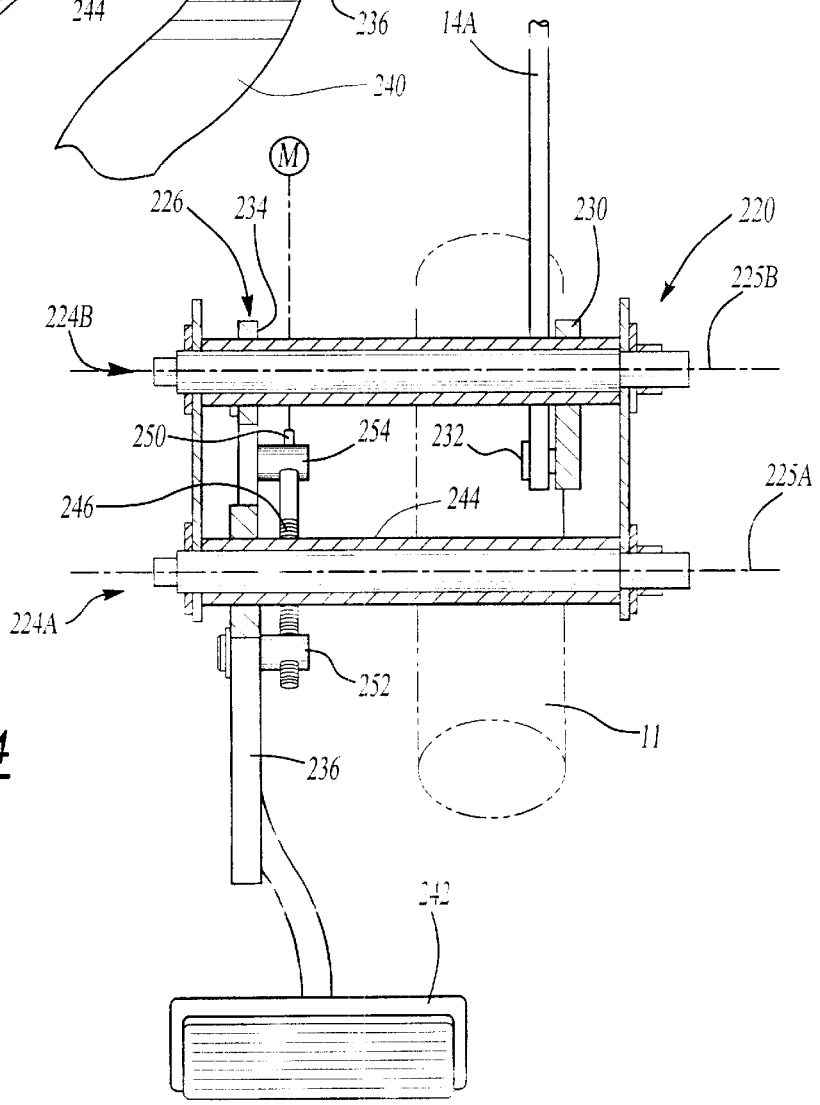
FIG. 14 is a broken view from the top of the adjustable pedal system of FIG. 13.

Referring now in detail to FIGS. 12 through 14, there is shown an adjustable brake pedal system 220 according to an alternative embodiment of the present invention. The adjustable brake pedal system 220 includes a pedal arm 236 for actuating the reaction member or pushrod 14A. Referring specifically to FIGS. 12 and 13, the pedal arm 236 is suspended at a pivot end 238 thereof from a mounting bracket 222 by a pedal support 224A. The pedal support 224A establishes a pedal axis of adjustment and actuation 225A about which the pedal arm 236 pivots. The pedal arm 236 is typically attached to the mounting bracket 222 located beneath the instrument panel of the vehicle such that the pedal arm 236 is rotatable in a direction away from the driver when the driver imparts a force to a pedal 242.

Referring now to FIG. 14, the pushrod 14A reciprocates along its own longitudinal axis away from the operator to actuate a piston within a brake booster (not shown) for purposes of selectively engaging the vehicle's brakes. In a more conventional pedal arrangement, the brake booster pushrod 14A would be directly attached to the pedal arm 236. In the present invention, however, the pedal arm 236 is indirectly connected to the brake booster pushrod 14A through an adjustment device 244 including a slave arm 226 in order to provide pedal adjustment and to circumnavigate a steering column 11. The slave arm 226 provides a lateral offset, without which the pedal arm 236 could not attach to the brake booster pushrod 14A due to interference with the steering column 11.

Referring again to FIG. 12, the slave arm 226 is generally an upside-down U-shaped member having a pivot end 228. A reaction end 230 extends from the pivot end 228 and terminates in a connection with the pushrod 14A using a reaction pin 232. Opposite the reaction end 230, an adjustment end 234 extends from the pivot end 228 and terminates in a connection with the pedal aim 236 via the adjustment device 244.

Referring to FIGS. 12 and 14, the position of the slave arm 226 relative to the pedal arm 236 is maintained by the slave arm 226 being rotatably mounted to the mounting bracket 222 about a slave support 224B that establishes a slave axis of actuation 225B, offset from the pedal axis 225A. Preferably, the slave arm 226 is pivotably attached to the mounting bracket 222 with the slave support 224B so as to mount between the pedal arm 236 and brake booster (not shown), so that the slave axis 225B is forward of the pedal axis 225A with respect to the longitudinal axis of the vehicle. The pedal and slave supports 224A and 224B are constructed and assembled to the mounting bracket 222 in accordance with knowledge available to one of skill in the art. Similarly, the attachment or fastening of the slave and pedal arms 226 and 236 to their respective supports is also in accordance with knowledge of one of skill in the art.

As illustrated in FIG. 14, the slave arm 226 is secured to an eyelet (not shown) of the pushrod 14A with the reaction pin 232. As with the embodiments of FIGS. 1 through 11, the eyelet establishes a datum that maintains position throughout any adjusting of the adjustable brake pedal system 220.

As shown in FIGS. 13 and 14, the adjustment device 244 is interposed the pedal arm 236 and the slave arm 226. The adjustment device 244 may be fastened to only one or both of the pedal arm 236 and slave arm 226. Adjustment of the pedal arm 236 through the adjustment device 244 preferably includes a drive motor 256 that connects to a stem portion 250 of an adjustment screw 246. The stem portion 250 of the adjustment screw 246 passes through a slave arm pin 254, and at an opposite end the adjustment screw 246 is threadably received in a pedal arm pin 252 that is rotatably secured to the pedal arm 236 intermediate the pivot end 238 and a pedal end 240. As a result, rotation of the adjustment screw 246 by the drive motor 256 causes fore or aft pivoting of the pedal arm 236, depending upon the drive motor's 256 direction of rotation.

Referring to FIG. 13, the adjustment screw 246 has an axis of screw rotation 247 that is spaced apart from and is transverse to the pedal axis 225A, thereby defining a lever arm force sufficient to displace the pedal arm 236 about the pedal axis 225A. Consequently, the drive motor 256 drives the adjustment screw 246 causing the adjustment screw 246 to be rotated about its adjustment axis of screw rotation 247 to threadingly drive the pedal arm pin 252, thereby causing a corresponding movement of the pedal arm 236 relative to the slave arm 226.

Referring again to FIG. 14, the pedal arm 236 is typically maintained in a forward position by a biasing effect of the brake booster pushrod 14A that is conventionally biased toward the vehicle's passenger compartment by a spring within the brake booster (not shown). Otherwise, the pedal arm 236 may also be biased toward the brake booster pushrod 14A by a suitable helical spring (not shown) so as to maintain positive engagement between the pedal arm 236 and the brake booster pushrod 14A. With the biasing effect of the brake booster pushrod 14A, positive contact is maintained at all times between the slave arm 226 and the pedal arm 236 through the adjustment device 244 to ensure positive mechanical action therebetween. In addition, the slave arm 226 prevents the rotation of the adjustment screw 246 from altering the position of the datum relative to the brake booster. Accordingly, any articulation of the pushrod 14A is avoided during the adjustment made to the pedal arm 236 by the adjustment device 244.

With reference to FIGS. 12 through 14, the mounting bracket 222, pedal arm 236, slave arm 226, and adjustment device 244 define a four-bar linkage arrangement having a single fixed link. The mounting bracket 222 represents the fixed link, the pedal arm 236 represents the crank link, the slave arm 226 represents the rocker link, and the adjustment device 244 represents the coupler link. The coupler link is of variable length to vary the pivotal position of the crank link while maintaining the position of the rocker link so as not to disturb the datum of the reaction member.

Accordingly, in operation the driver initiates the drive motor 256 when it is desired to adjust the pedal arm 236 from one adjustment position to another, such as from a far forward position, backwards to a rearward position closer to the driver of the vehicle. Upon being energized, the drive motor 256 rotates the adjustment screw 246. As the adjustment screw 246 rotates, the pedal arm 236 is pivoted about the axis of adjustment and actuation 225A and is therefore moved in a direction relative to the slave arm 226, such as away from the slave arm 226 when adjusting the pedal arm 236 toward the driver. The pedal arm 236 thus rotates along its own plane substantially parallel with the longitudinal axis of the vehicle, and substantially perpendicular to the pedal arm axis 225A.

When an operator applies an input force to the pedal 242, the pedal arm 236 pivots about an axis of actuation defined by the pedal support 224A, causing the input force to be imparted through the adjustment device 244 to the adjustment end 234 of the slave arm 226. Accordingly, the slave arm pivots about the slave axis of actuation 225B defined by the slave arm support 224B. The input force is further imparted across the pivot end 228, down the reaction end 230 of the slave arm 226, and into the brake booster pushrod 14A. Finally, the brake booster pushrod 14A displaces a piston within the brake booster to operate the vehicle's brakes.

The reaction end 230 of the slave arm 226 thus rotates along its own plane substantially parallel with the longitudinal axis of the vehicle and substantially perpendicular to the slave axis 225B. The planes of rotation formed by the pedal arm 236 and reaction end 230 are laterally offset in order to circumnavigate the steering column 11. Thus, the pedal arm 236 can be rotated through its entire operational envelope without any interference with the steering column 11.

From the above, it can be appreciated that a significant advantage of the present invention is that it provides a large range of forward and rearward adjustment of a pedal and may be easily adapted to an existing vehicle without requiring significant cost or complexity.

Another advantage is that compared to the prior art the present invention requires a minimum of hardware and a minimum of space beneath the instrument panel to accommodate the adjustable pedal system, nor is there a significant penalty in terms of added weight, cost, or complexity.

Yet another advantage is that at least one embodiment of the present invention uses but one pivot axis, thereby requiring less packaging space under the instrument panel. Additionally, the adjustment mechanism is packaged compactly to the unique configuration of the inverted bellcrank for an overall compact adjustment mechanism. Accordingly, the present invention can be readily adapted or "dropped into" existing vehicle designs.

Still another advantage of the present invention is that an adjustable pedal assembly can be easily retrofitted to an existing vehicle compartment without interfering with structural members, such as a steering column.

A further advantage is that the present invention may be accomplished with a more conventional single-axis control pedal assembly or a dual-axis control pedal assembly, depending upon the requirements of a given application.

Yet a further advantage is that the present invention permits a standard brake booster and pushrod to be used, without having to change the position of the brake booster or use a pushrod having unusual geometry to circumnavigate a steering column.

While the present invention has been described in terms of a preferred embodiment, it is apparent that other forms could be adopted by one skilled in the art. For example, it is contemplated that the lead screw can be replaced with a wire cable assembly in order to allow adjustment to be made manually if desired. Alternatively, the adjustment of the pedal arm can be achieved with the drive motor that connects to a lead screw mounted transversely with respect to the drive motor. Another option would involve the drive motor being connected to a cam that acts upon cam surfaces on the slave arm and pedal arm for adjustment. Additionally, the embodiments above operate in similar fashion and share some common structural componentry. Therefore, descriptions of such common componentry and operation thereof apply to each of the embodiments. Accordingly, the scope of the present invention is to be limited only by the following claims.

What is claimed is:

1. An adjustable pedal system for adjusting a pedal with respect to a datum on a reaction member of a vehicle, said adjustable pedal system comprising:

an axis of adjustment;

at least one axis of actuation co-axially aligned with said axis of adjustment;

a pedal arm that is pivotable about said at least one axis of actuation and said axis of adjustment, said pedal arm terminating in a pedal end;

a slave arm having a pivot end pivotally mounted about said at least one axis of actuation, said slave arm having an adjustment end opposite said pivot end; and adjustment means for pivotally adjusting the position of said pedal arm with respect to said slave arm about said axis of adjustment, said adjustment means linking said adjustment end of said slave arm said pedal arm.

2. The adjustable pedal system as claimed in claim 1, wherein said slave arm is bellcrank shaped and has a reaction end connected to said datum of said reaction member, and further wherein said reaction end is angularly offset in a rearward direction from said adjustment end.

3. The adjustable pedal system as claimed in claim 1, wherein said pedal arm further comprises an offset end pivotally aligned and attached to said adjustment end of said slave arm, said offset and adjustment ends establishing said axis of adjustment, and wherein said adjustment means pivots said pedal arm about said axis of adjustment, said pedal arm and said slave arm being adapted to pivot about said at least one axis of actuation upon application of a force to said pedal end of said pedal arm by an operator of said vehicle.

4. The adjustable pedal system as claimed in claim 1, wherein said at least one axis of actuation comprises a pedal axis of actuation and a slave axis of actuation offset from and substantially parallel to said pedal axis of actuation, said slave arm being pivotably mounted about said slave axis of actuation, said pedal arm being pivotably mounted about said pedal axis of actuation, wherein said adjustment means pivots said pedal arm about said pedal axis of actuation, and further wherein said pedal arm and said slave arm are pivotable about said at least one axis of actuation upon application of a force to said pedal arm by an operator of said vehicle.

5. An adjustable pedal system for adjusting the position of a pedal with respect to a datum on a reaction member for the comfort of an operator within a vehicle, said adjustable pedal system comprising:

a support mounted within said vehicle and establishing an axis of adjustment and at least one axis of actuation co-axially aligned with said axis of adjustment;

a slave arm comprising a pivot end pivotally mounted about said at least one axis of actuation of said support, said slave arm having an adjustment end and a reaction end both extending from said pivot end, said reaction end being connected to said datum for actuating said reaction member upon pivotal motion of said slave arm;

a pedal arm comprising a pivot end pivotally mounted about said at least one axis of actuation of said support, said pedal arm extending from said pivot end to a pedal end having said pedal attached thereto, said pedal arm being pivotably adjustable with respect to said datum of said reaction member;

adjustment means for pivotally adjusting the position of said pedal arm relative to said slave arm about said axis of adjustment, said adjustment means linking said adjustment end of said slave arm to a point on said pedal arm intermediate said pivot and pedal ends of said pedal arm, said adjustment means being spaced from said at least one axis of actuation, said adjustment means being operable for pivoting said pedal arm with respect to said slave arm between forward and rearward adjustment positions; and drive means interconnected with said adjustment means for driving said adjustment means;

whereby as said drive means drives said adjustment means, said pedal arm is pivoted about said at least one axis of actuation between and including said forward and rearward adjustment positions, and further whereby as the operator applies a force to said pedal, the force is imparted to said pedal arm to rotate said pedal arm about said at least one axis of actuation, and said adjustment means is displaced causing said slave arm to pivot about said axis of adjustment and displace said reaction member to control said vehicle in a desired manner.

6. The adjustable pedal system as claimed in claim 5, wherein said slave arm is bellcrank-shaped and said reaction end is angularly offset from said adjustment end, further wherein said at least one axis of actuation comprises a single common axis about which said pedal and slave arms are coaxially mounted.

7. The adjustable pedal system as claimed in claim 6, wherein said drive means comprises:

a drive motor and a gearbox engaged with said drive motor, said gearbox further engaging said adjustment mend to establish a driving relationship therewith, said gearbox rotating said adjustment means in one direction when said drive motor is activated in a first direction and further rotating said adjustment means in an opposite direction when said drive motor is actuated in a second direction, such that as said adjustment means is rotated said pedal arm is pivoted about said at least one axis of actuation.

8. The adjustable pedal system as claimed in claim 6, wherein said adjustment means comprises:

a pedal arm pin pivotably connected to said pedal arm;

a slave arm pin pivotably connected to said slave arm; and an adjustment screw having a threaded body threaded into said pedal arm pin and further having a stem portion extending through said slave arm pin;

such that as said adjustment screw rotates said pedal arm pin traverses the length of said threaded body of said adjustment screw to adjust the position of said pedal arm.

9. The adjustable pedal system as claimed in claim 8, wherein said drive means comprises:

a drive motor and gearbox engaged with said drive motor, said gearbox further engaging said stem portion of said adjustment screw to establish a driving relationship therewith, said gearbox rotating said adjustment screw in one direction when said drive motor is activated in a first direction and further rotating said adjustment screw in an opposite direction when said drive motor is actuated in a second direction, such that as said adjustment screw is rotated said pedal arm is pivoted about said at least one axis of actuation.

10. The adjustable pedal system as claimed in claim 5, wherein said support, said pedal arm, said slave arm, and said adjustment means define a single fixed link four-bar linkage arrangement wherein said slave arm is U-shaped and said reaction end is laterally offset from said adjustment end, further wherein said at least one axis of actuation comprises a pedal axis of actuation and a slave axis of actuation substantially parallel with and spaced apart from said pedal axis of actuation and said pivot end of said slave arm being pivotally mounted about said slave axis of actuation, said pivot end of said pedal arm being pivotably mounted about said pedal axis of actuation, wherein said adjustment means pivotally adjusts the position of said pedal arm relative to said slave arm about said pedal axis of actuation, said pedal arm and said slave arm being adapted to pivot about said at least one axis of actuation upon application of a force to said pedal by the operator of said vehicle.

11. The adjustable pedal system as claimed in claim 10, wherein said drive means comprises:

a drive motor and gearbox engaged with said drive motor, said gearbox further engaging said adjustment means to establish a driving relationship therewith, said gearbox rotating said adjustment means in one direction when said drive motor is activated in a first direction and further rotating said adjustment means in an opposite direction when said drive motor is actuated in a second direction, such that as said adjustment means is rotated said pedal arm is pivoted about said pedal axis of actuation.

12. The adjustable pedal system as claimed in claim 10, wherein said adjustment means comprises:

a pedal arm pin pivotably connected to said pedal arm;

a slave arm pin pivotable connected to said slave arm; and an adjustment screw having a threaded body threaded into said pedal arm pin and further having a stem portion extending through said slave arm pin;

such that as said adjustment screw rotates said pedal arm pin traverses the length of said threaded body of said adjustment screw to adjust the position said pedal arm.

13. The adjustable pedal system as claimed in claim 12, wherein said drive means comprises:

a drive motor and gearbox engaged with said drive motor, said gearbox further engaging said stem portion of said adjustment screw to establish a driving relationship therewith, said gearbox rotating said adjustment screw in one direction when said drive motor is activated in a first direction and further rotating said adjustment screw in an opposite direction when said drive motor is actuated in a second direction, such that as said adjustment screw is rotated said pedal arm is pivoted about said pedal axis of actuation.

14. An adjustable pedal system for adjusting the position of a pedal with respect to a datum on a reaction member within a vehicle for the comfort of an operator, said compact adjustable pedal system comprising:

a support mounted within said vehicle and establishing an axis of adjustment and at least one axis of actuation co-axially aligned with said axis of adjustment;

a slave arm comprising a pivot end pivotally mounted about said at least one axis of actuation, said slave arm extending from said pivot end to an adjustment end, said slave arm further comprising a datum attachment portion for connecting with said datum of said reaction member;

a pedal arm comprising a pedal end and an offset end opposite said pedal end, said pedal arm further comprising an arcuate slot between said pedal and offset ends, said pedal arm being mounted about said at least one axis of actuation through said arcuate slot, said offset end of said pedal arm being fixed to said adjustment end of said slave arm, said offset end of said pedal arm and said adjustment end of said slave arm establishing said axis of adjustment, said pedal arm and said slave arm being adapted to pivot about said at least one axis of actuation upon application of a force to said pedal by the operator of said vehicle;

adjustment means mounted to one of said pedal arm and said slave arm and connected to the other of said pedal arm and said slave arm for pivoting said pedal arm about said axis of adjustment, said adjustment means being adapted to of pivot said pedal arm between forward and rearward adjustment positions with respect to said slave arm; and drive means interconnected with said adjustment means for driving said adjustment means;

whereby as said drive means drives said adjustment means said pedal arm is pivoted about said axis of adjustment, and flier whereby as the operator applies a force to said pedal, the force is imparted to said pedal arm to rotate said pedal arm about said at least one axis of actuation, such that said adjustment means is displaced causing said slave arm to pivot and displace said reaction member to control said vehicle in a desired manner.

15. The adjustable pedal system as claimed in claim 14, wherein said drive means comprises:

a drive motor and gearbox engaged with said drive motor, said gearbox further engaging said adjustment mew to establish a driving relationship therewith, said gearbox rotating said adjustment means in one direction when said drive motor is activated in a first direction and further rotating said adjustment means in an opposite direction when said drive motor is actuated in a second direction, such that as said adjustment means is rotated said pedal arm is pivoted about said axis of adjustment.

16. The adjustable pedal system as claimed in claim 14, wherein said adjustment means comprises:

an adjustment screw having a threaded body;

a pin threadingly engaged with said adjustment screw, said pin pivotably connected with one of said pedal arm and said slave arm; and means for mounting said adjustment screw to the other of said pedal arm and said slave arm;

such that as said adjustment screw rotates, said pin traverses the length of said threaded body of said adjustment screw.

17. The adjustable pedal system as claimed in claim 16, wherein said drive means comprises:

a drive cable; and a drive motor and gearbox complementary with said drive motor, said gearbox engaging said adjustment screw through said drive cable to establish a driving relationship therewith, said gearbox rotating said adjustment screw in one direction when said drive motor is activated in a first direction and further rotating said adjustment screw in an opposite direction when said drive motor is actuated in a second direction, such that as said adjustment screw is rotated said pedal arm is pivoted about said axis of adjustment.

18. The adjustable pedal system as claimed in claim 14, wherein said adjustment means comprises:

an adjustment screw having a threaded body and a ball end terminating said threaded body;

a bracket engaged with said ball end of said adjustment screw, said bracket pivotably connected with one of said pedal arm and said slave arm; and means for mounting said adjustment screw to the other of said pedal arm and said slave arm, said threaded body being threadingly engaged with said means for mounting said adjustment screw;

such that as said adjustment screw rotates, said adjustment screw traverses through said means for mounting said adjustment screw to pivot said pedal arm.

19. The adjustable pedal system as claimed in claim 18, wherein said drive means comprises:

a drive cable; and a drive motor and gearbox complementary with said drive motor, said gearbox engaging said adjustment screw through said drive cable to establish a driving relationship therewith, said gearbox rotating said adjustment screw in one direction when said drive motor is activated in a first direction and further rotating said adjustment screw in an opposite direction when said drive motor is actuated in a second direction, such that as said adjustment screw is rotated said pedal arm is pivoted about said axis of adjustment.

20. A method of adjusting a pedal arm adapted to pivot about at least one axis of actuation with respect to a datum on a reaction member in a vehicle, said method comprising the steps of:

providing an axis of adjustment in said vehicle;

providing said at least one axis of actuation in said vehicle, said at least one axis of actuation being co-axially aligned with said axis of adjustment;

pivotally positioning said pedal arm about said at least one axis of actuation and said axis of adjustment;

pivotally positioning a slave arm about said at least one axis of actuation at a pivot end of said slave arm;

attaching said slave arm to said datum of said reaction member;

positioning an adjustment means a predetermined distance from said at least one axis of actuation;

pivotally connecting said adjustment means between said slave arm and said pedal arm; and actuating said adjustment means to pivotally adjust said position of said pedal arm with respect to said slave arm.

21. An adjustable pedal system for an automotive vehicle, said adjustable pedal system comprising:

a mounting bracket having a pedal axis and a slave axis spaced a predetermined distance from said pedal axis;

an offset slave arm pivotally mounted about said slave axis, said offset slave arm having a reaction end and an adjustment end laterally offset from said reaction end;

a pushrod for controlling said automotive vehicle, said pushrod having one end connected to said reaction end of said offset slave arm whereby axial motion of said pushrod occurs upon limited pivotal motion of said offset slave arm;

a pedal arm having a pivot end pivotally mounted about said pedal axis, said pedal arm further having a pedal end opposite said pivot end such that said pedal end of said pedal arm pivots about said pedal axis; and an adjustment device pivotally connecting said pedal arm with said adjustment end of said offset slave arm, said adjustment device being operable to vary the pivotal position of said pedal arm;

whereby as said adjustment device is actuated, said pedal arm pivots about said pedal axis in a fore and aft direction of said vehicle, thereby adjusting a fore and aft position of said pedal.

* * * * *

UNITED STATES PATENT AND TRADEMARK OFFICE

CERTIFICATE OF CORRECTION

PATENT NO. : 6,431,022 B1
DATED : August 13, 2002
INVENTOR(S) : Edmond Burton Cicotte It is certified that error appears in the above-identified patent and that said Letters Patent is hereby corrected as shown below:

Title page,
Item [74], delete “Vanophem & Vanophem”, and insert -- VanOphem & VanOphem --.

Column 3,
Line 24, delete “modem”, and insert -- modern --.

Column 4,
Line 31, delete “farther”, and insert -- further --.

Column 10,
Line 61, delete “an upside-down”, and insert -- a --.
Line 61, “U-shaped”, insert -- or offset --.

Column 13,
Line 40, after “slave arm”, insert -- to --.

Column 14,
Line 52, delete “mend”, and insert -- means --.

Column 16,
Line 38, delete “flier”, and insert -- further --.
Line 42, delete “slaye”, and insert -- slave --.
Line 48, delete “mew”, and insert -- means --.

Signed and Sealed this

Twenty-second Day of April, 2003

JAMES E. ROGAN
*Director of the United States Patent and Trademark Office*

UNITED STATES PATENT AND TRADEMARK OFFICE

CERTIFICATE OF CORRECTION

PATENT NO. : 6,431,022 B1
DATED : August 13, 2002
INVENTOR(S) : Edmond Burton Cicotte It is certified that error appears in the above-identified patent and that said Letters Patent is hereby corrected as shown below:

Title page,
Item [74], delete "Vanophem & Vanophem", and insert -- VanOphem & VanOphem --.

Column 3,
Line 24, delete "modem", and insert -- modern --.

Column 4,
Line 31, delete "farther", and insert -- further --.

Column 10,
Line 61, delete "an upside-down", and insert -- a --.
Line 61, after "U-shaped", insert -- or offset --.

Column 13,
Line 40, after "slave arm", insert -- to --.

Column 14,
Line 52, delete "mend", and insert -- means --.

Column 16,
Line 38, delete "flier", and insert -- further --.
Line 42, delete "slaye", and insert -- slave --.
Line 48, delete "mew", and insert -- means --.

This certificate supersedes Certificate of Correction issued April 22, 2003

Signed and Sealed this

Twenty-sixth Day of August, 2003

JAMES E. ROGAN
*Director of the United States Patent and Trademark Office*